US006189819B1

(12) United States Patent
Racine

(10) Patent No.: US 6,189,819 B1
(45) Date of Patent: Feb. 20, 2001

(54) MILL DOOR IN COAL-BURNING UTILITY ELECTRICAL POWER GENERATION PLANT

(75) Inventor: David G. Racine, Ishpeming, MI (US)

(73) Assignee: Wisconsin Electric Power Company (WEPCO), Milwaukee, WI (US)

( * ) Notice: Under 35 U.S.C. 154(b), the term of this patent shall be extended for 0 days.

(21) Appl. No.: 09/315,916

(22) Filed: May 20, 1999

(51) Int. Cl.[7] ..... B02C 17/18
(52) U.S. Cl. ..... 241/176; 241/178; 241/179
(58) Field of Search ..... 241/176, 177, 241/178, 179, 285.3

(56) References Cited

U.S. PATENT DOCUMENTS 3,614,002 * 10/1971 Dore ..... 241/51
3,955,766 * 5/1976 Chang ..... 241/56
4,682,738 * 7/1987 Chang ..... 241/56
6,119,969 * 9/2000 Racine ..... 241/101.2

* cited by examiner

*Primary Examiner*—Joseph J. Hail, III
*Assistant Examiner*—William Hong
(74) *Attorney, Agent, or Firm*—Andrus, Sceales, Starke & Sawall, LLP

(57) ABSTRACT

A mill in a coal-burning utility electrical power generation plant has a rotary drum for pulverizing coal, and has a mill head at an axial end thereof. A stationary divider plate divides the mill head into an entrance receiving coal, and an exit discharging pulverized coal dust. An openable door on the mill head is moveable between a closed position and an open position. The door in the closed position is intersected by the rotational axis of the drum and has a lateral dimension transverse to such axis and greater than the inner diameter of the mill head. The door in the closed position spans the divider plate and closes both the entrance and exit of the mill head. The door in the open position exposes both the entrance and the exit. The divider plate may be removed by withdrawing it axially through the door opening without cutting the divider plate into multiple sub-pieces.

29 Claims, 10 Drawing Sheets

MILL DOOR IN COAL-BURNING UTILITY ELECTRICAL POWER GENERATION PLANT

BACKGROUND AND SUMMARY

The invention relates to coal-burning utility electrical power generation plants, and more particularly to a mill head access door.

In a coal-burning utility electrical power generation plant, a ball tube mill is provided for pulverizing the coal. The mill includes a drum rotational about an axis and having mill heads at distally opposite axial ends thereof. Stationary dividing plates divide each respective mill head into an entrance receiving coal, and an exit discharging pulverized coal dust. Openable doors on the mill heads allow access by maintenance personnel, including scheduled removal and replacement of the respective divider plate.

The work performed in the mill is particularly difficult. It is performed in a confined space, and requires precautionary measures to protect personnel prior to entry into the mill. The atmosphere is hot and dirty, especially because of the coal dust. Some areas of the mill are very small and quite uncomfortable to work in for the majority of individuals. Some of the parts within the mill to be replaced are large and require mechanical lifting equipment to install, and in some cases require sizing or cutting to fit through the door opening. The noted divider plate must be cut, for example, by an acetylene torch into four or more pieces, to fit through the door opening. In the replacement of mill liners, the mill end has to be cut in order to gain access to do the work.

To solve the above noted problems, a new modified design has been developed to allow better access to the mill for personnel and equipment for numerous tasks, including repair of the inlet side of the mill, repair or replacement of the curtain protecting the expansion joint, repair or replacement of the divider plate separating the inlet and outlet, replacement or measurement of the ball charge, i.e. the 1 ½ inch diameter balls in the mill, and repair or replacement of the mill head and barrel liners. The new design accomplishes its goals without jeopardizing the structural integrity of the mill end. An advantage is that the divider plate can be removed or installed as one piece, without cutting it into multi-pieces, by bolting it in place. With the prior design, the divider plate had to be cut into four pieces and welded internally in the mill. The present access and removal features also improve the ability of maintenance personnel to access the inlet and outlet ducts. The present design results in significant cost savings in maintenance, man hours and downtime.

DETAILED DESCRIPTION

Figure 1:
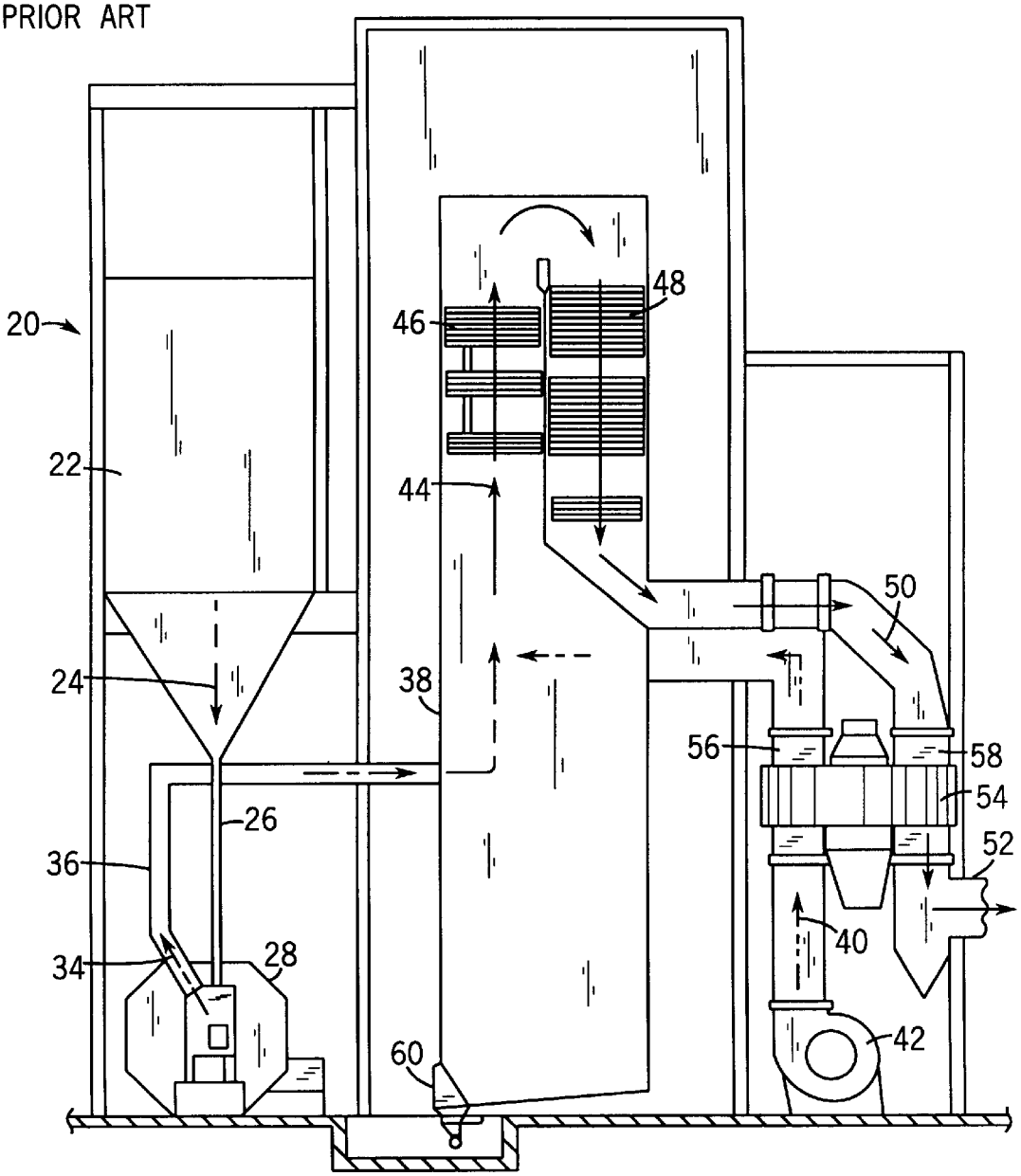
FIG. 1 PRIOR ART
FIG. 1 is a schematic illustration of a portion of a coal-burning utility electrical power generation plant.

FIG. 1 shows a portion of a coal-burning utility electrical power generation plant 20. Coal is loaded into hopper 22 and gravity fed as shown at arrow 24 to inlet duct 26 of ball tube mill 28. The mill includes a rotary drum 30, FIG. 2, with a charge or plurality of balls 32, FIG. 4, therein which pulverize the coal as the drum rotates. The pulverized coal dust is discharged as shown at arrow 34, FIG. 1, to outlet duct 36 for introduction to the burner of boiler 38. Incoming combustion air is supplied as shown at arrow 40 from fan 42. The heat of combustion of the air and coal dust is supplied as shown at arrow 44 through a plurality of heat exchangers 46, 48, to generate steam to in turn drive electrical power generating turbines, as is standard. After giving up heat for the noted steam generation, exhaust including fly ash flows as shown at arrow 50 to exhaust outlet 52. An air preheater duct 54 is connected between combustion air inlet duct 56 and exhaust outlet duct 58 for transferring heat from the exhaust flow at 50 to the incoming combustion air flow at 40 to pre-heat the latter. The spent coat dust, after ignition and burning, fuses as hardened chunks, called bottom ash clinkers, and are collected and ground at lower clinker grinder 60, for discharge and disposal.

Figure 2:
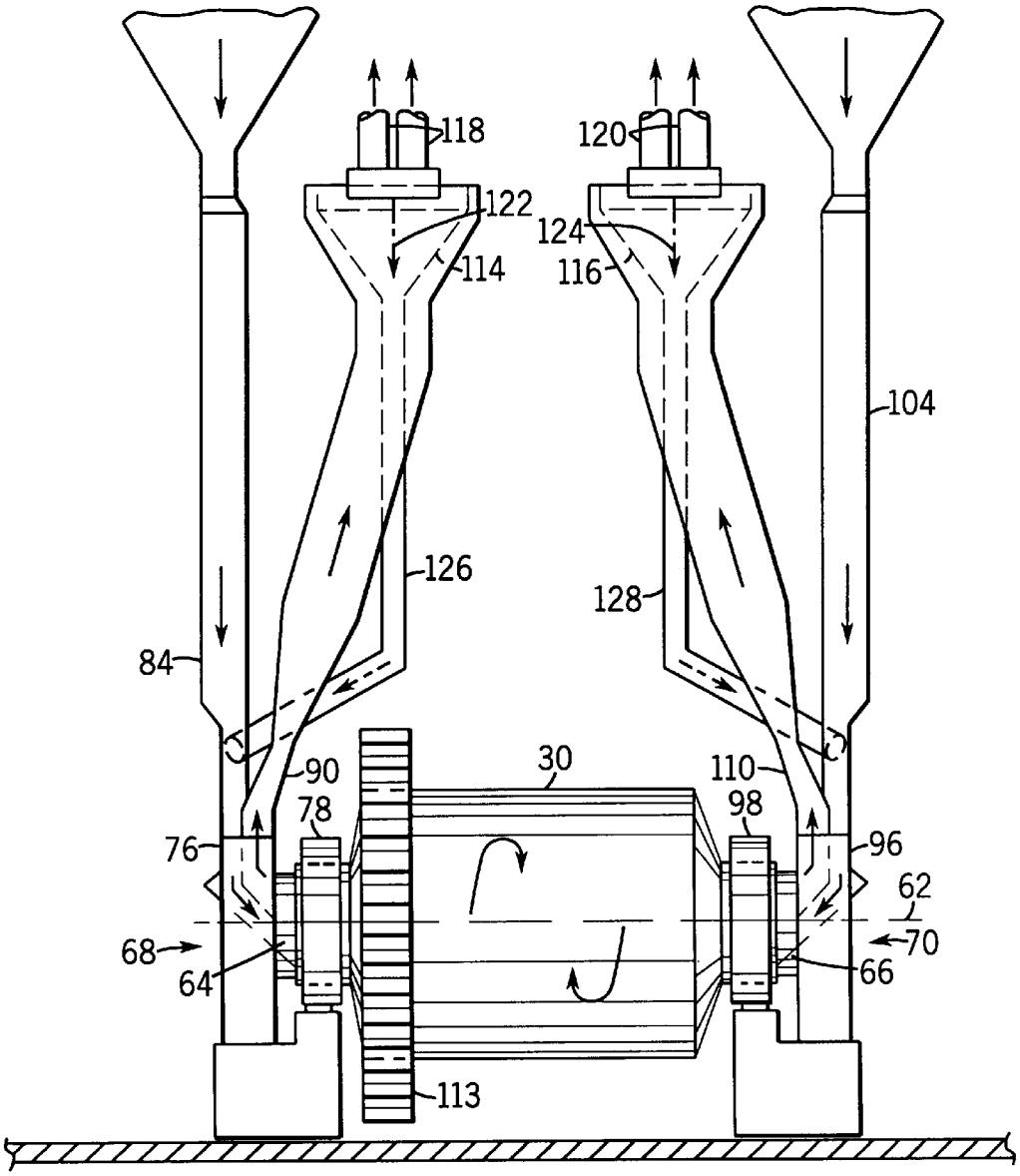
FIG. 2 PRIOR ART
FIG. 2 is a schematic side view of the mill of FIG. 1.
Figure 3:
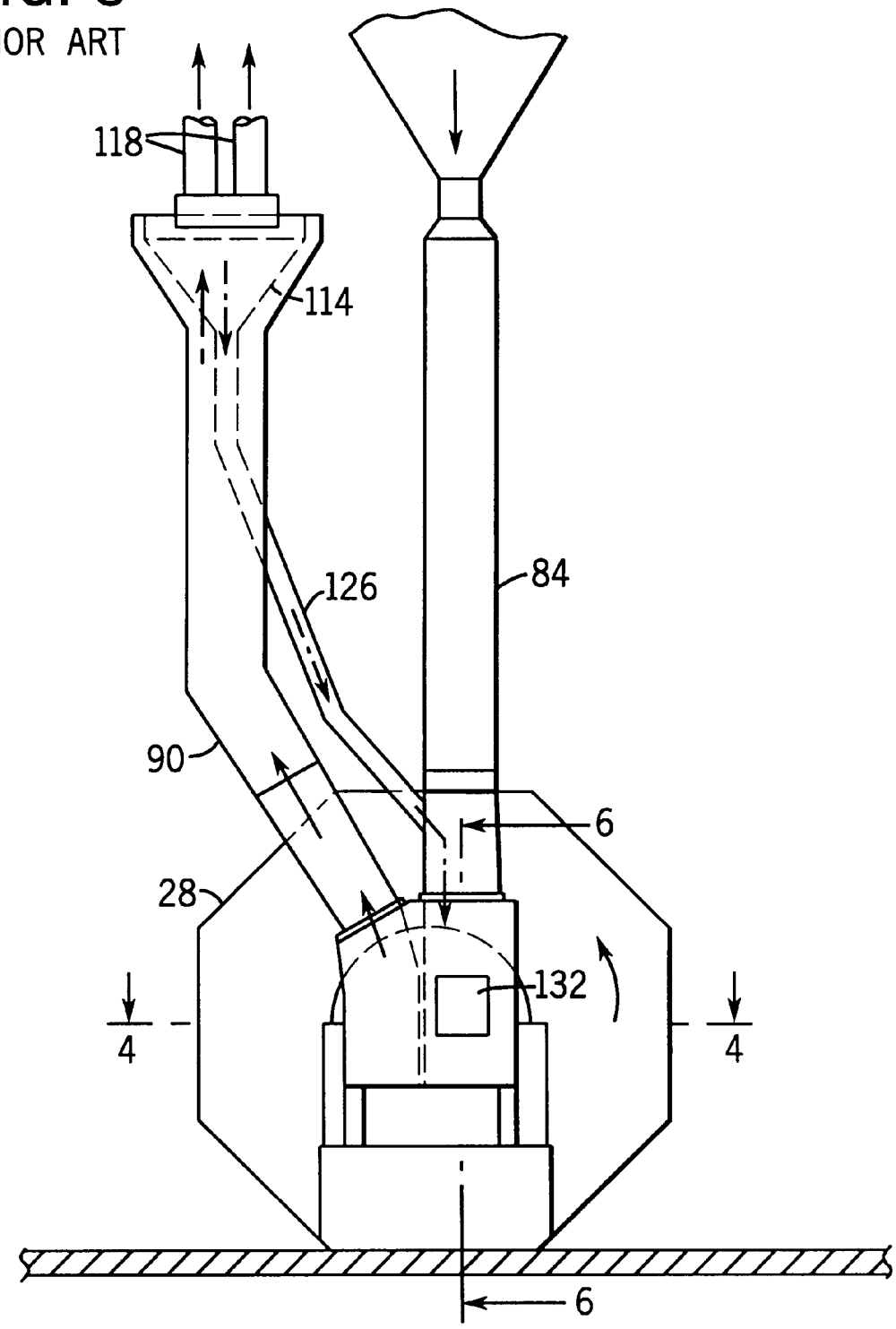
FIG. 3 PRIOR ART
FIG. 3 is an enlarged schematic view of a portion of FIG. 1.

Drum 30, FIG. 2, rotates about an axis 62 and has a pair of mill heads 64 and 66 at the respective axial ends 68 and 70 thereof. Each mill head has a respective stationary divider plate 72 and 74, FIG. 4, dividing its respective mill head into an entrance or inlet side receiving coal, and an exit or outlet side discharging pulverized coal dust. Stationary divider plate 72 is rigidly mounted, for example, by welding, to stationary framework 76 which supports mill head 64 at trunnion bearing 78 for rotation of drum 30. Divider plate 72 divides mill head 64 into an entrance 80 receiving coal as shown at arrow 82 from inlet duct 84, and an exit 86 discharging pulverized coal dust as shown at arrow 88 to outlet duct 90. Mill head 64 includes spiral wound rifling 92 along its inner perimeter to channel coal from entrance 80 into central crushing pulverizing zone 94 as the drum rotates, such that the coal is pulverized by balls 32. Stationary divider plate 74 is rigidly fixed, typically by welding, to framework 96 which supports mill head 66 at bearing 98 for rotation of the drum. Stationary divider plate 74 divides mill head 66 into an entrance 100 receiving coal as shown at arrow 102 from inlet duct 104, and an exit 106 discharging coal dust as shown at arrow 108 to outlet duct 110. Mill head 66 has internal rifling 112 to channel the coal into pulverizing zone 94 during rotation of the drum. Drum 30 has an outer ring gear 113 driven by helical gearing (not shown), to rotate the drum.

As shown in FIG. 2, the exiting coal dust from each axial end mill head is supplied through respective outlet ducts 90 and 110, and swirls around respective frusto-conical collectors 114 and 116, such that the lighter dust particles continue through conduits 118 and 120 to burner 38, FIG. 1, and the heavier particles are collected in such frusto-conical collectors 114 and 116 and are recycled as shown as respective arrows 122 and 124 and return ducts 126 and 128 back to respective inlet ducts 84 and 104. Drum 30 is typically lightly pressurized with a slightly higher internal pressure than atmospheric, to facilitate discharge of coal dust through exits 86 and 100 to respective outlet ducts 90 and 104.

Figure 4:
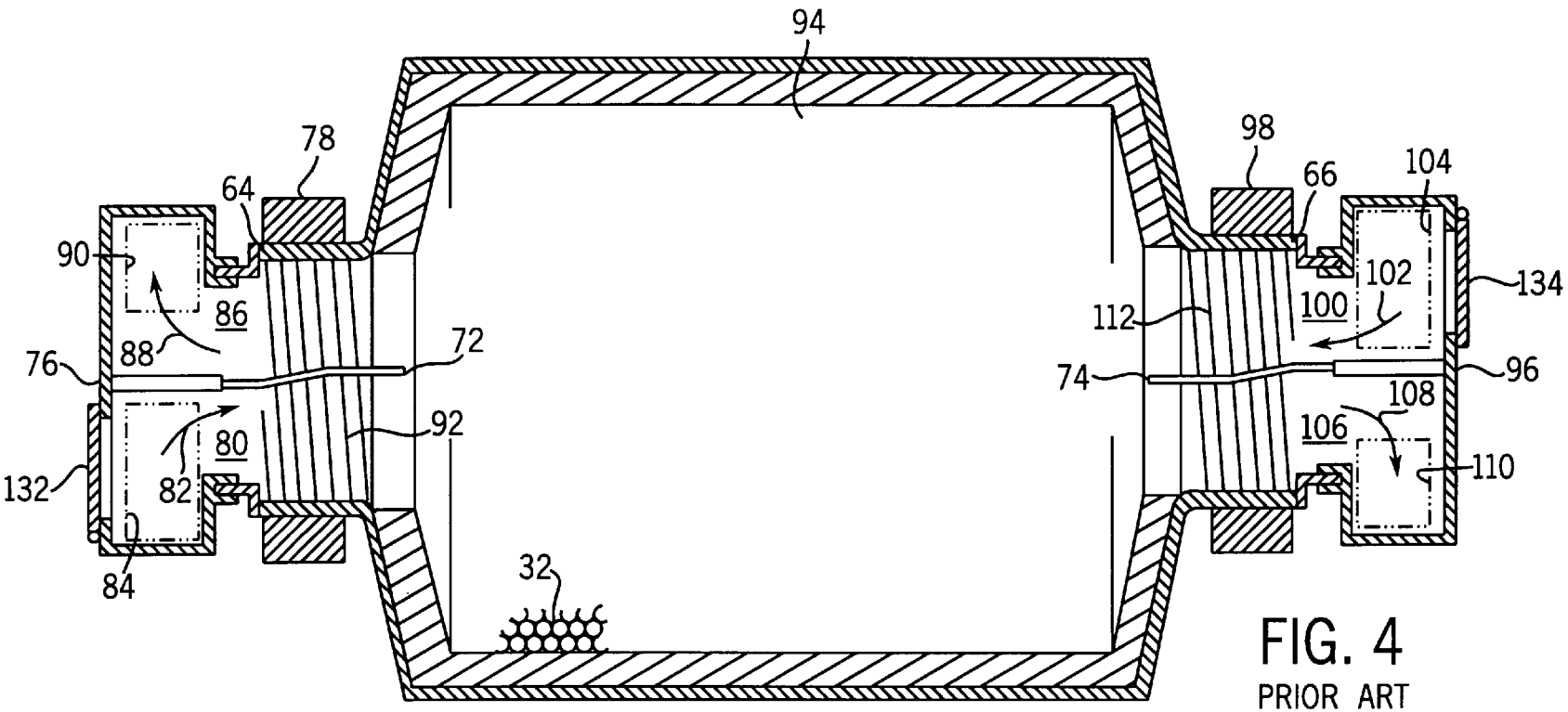
FIG. 4 PRIOR ART
FIG. 4 is a sectional view taken along line 4—4 of FIG. 3.
Figure 6:
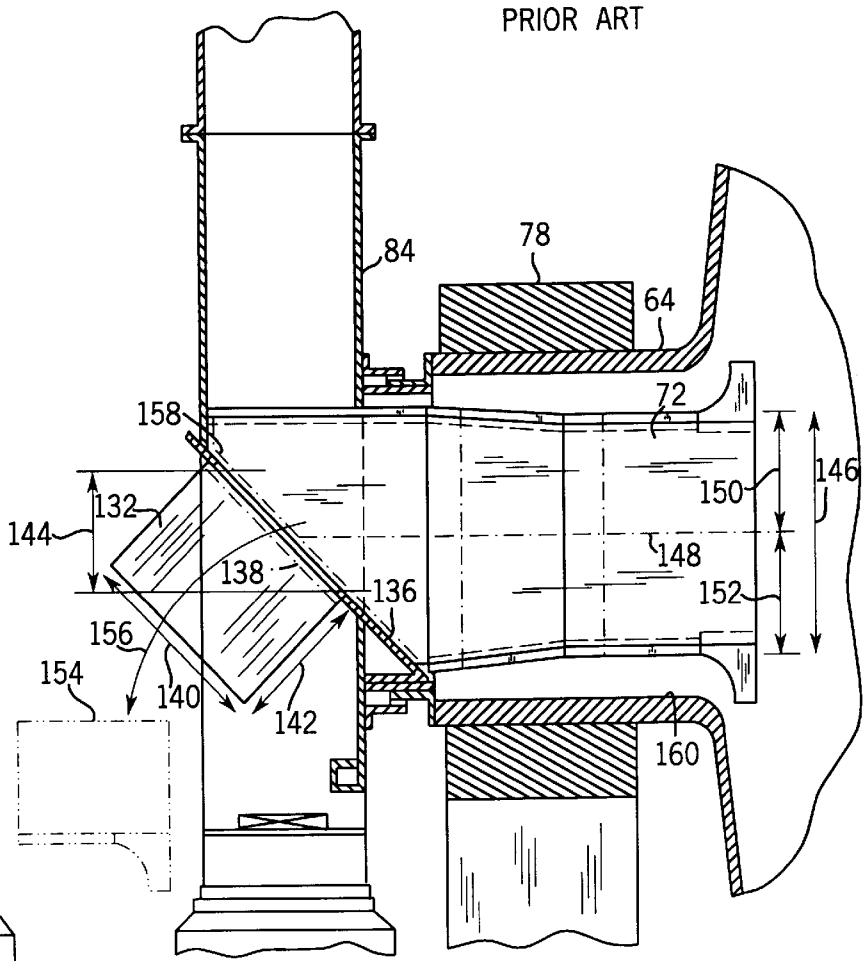
FIG. 6 PRIOR ART
FIG. 6 is a sectional view taken along line 6—6 of FIG. 3.
Figure 5:
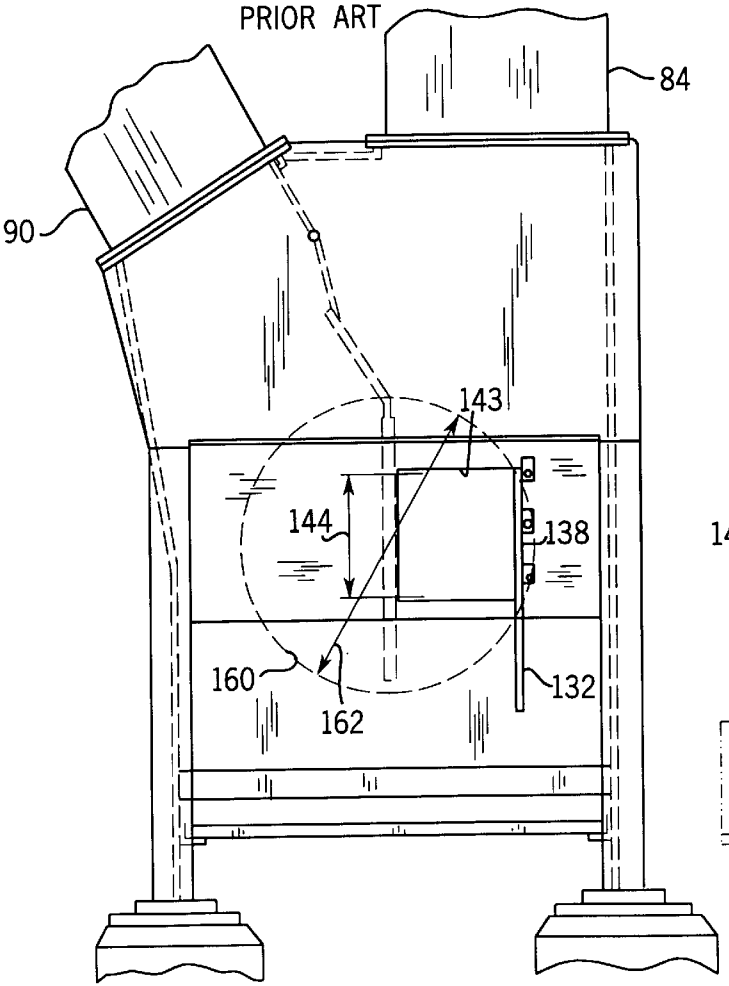
FIG. 5 PRIOR ART
FIG. 5 is an end view of the mill head of FIG. 4.
Figure 8:
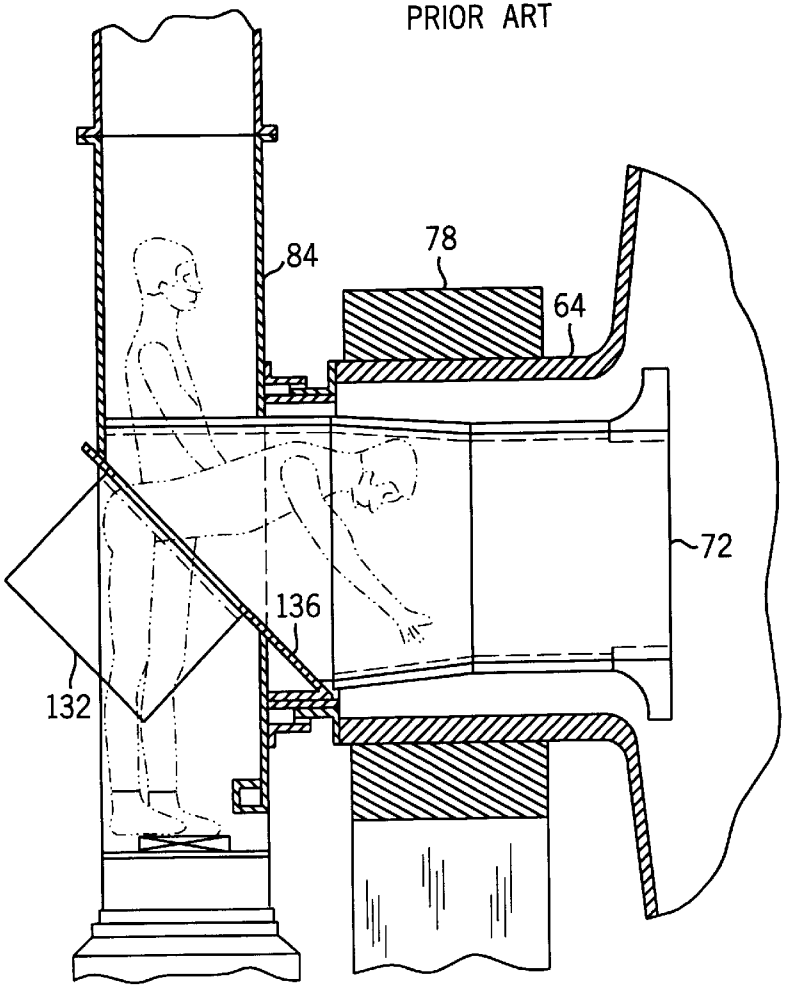
FIG. 8 PRIOR ART
FIG. 8 is a view like FIG. 6, and schematically illustrates servicing by maintenance personnel.
Figure 7:
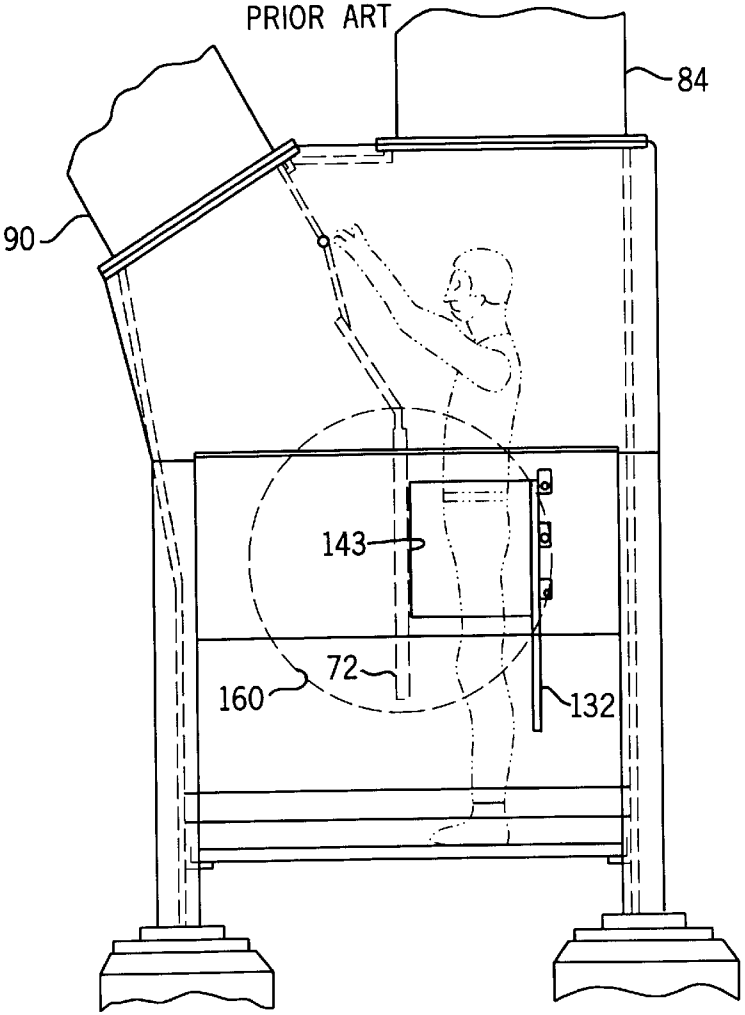
FIG. 7 PRIOR ART
FIG. 7 is a view like FIG. 5, and schematically illustrates servicing by maintenance personnel.

Openable doors 132 and 134, FIG. 4, are provided on the opposite axial end mill heads and are moveable between a closed position, FIG. 4, and an open position, FIGS. 5–8. The door is hinged to the axial end of the mill head along a downwardly and axially sloped diagonal stationary wall 136, FIG. 6, along a hinge line 138. The door is typically about 21 inches high as shown at dimension 140, and 16 inches wide, as shown at dimension 142, which are approximately the same dimensions as the door opening 143 in diagonal wall 136. When the door is swung open along diagonal hinge line 138, the vertical projection of the door opening is shown at dimension 144. The vertical height 146 of divider plate 72 is greater than dimension 144, and hence divider plate 72 must be cut into smaller pieces to enable removal thereof through the door opening. Divider plate 72 is typically cut along axial line 148 into halves, each having a respective vertical dimension 150,152 no greater than dimension 144. Each of these halves is then typically cut along one or more vertical lines into further sub-pieces, one of which is shown in FIG. 6 at 154 removed through door opening 143 as shown at arrow 156. Divider plate 72 has a left diagonal end 158 welded to diagonal wall 136 to stationarily mount divider plate 72 in mill head 64 to divide the latter into the noted entrance 80 and exit 86. The mill head has an inner perimeter as shown at 160, FIG. 5, having an inner diameter 162 of about four feet. FIGS. 7 and 8 schematically illustrate the cramped conditions within which maintenance personnel have to work to service the ductwork, for example in FIG. 7, and the mill head, FIG. 8, including cutting and removing of divider plate 72.

Figure 9:
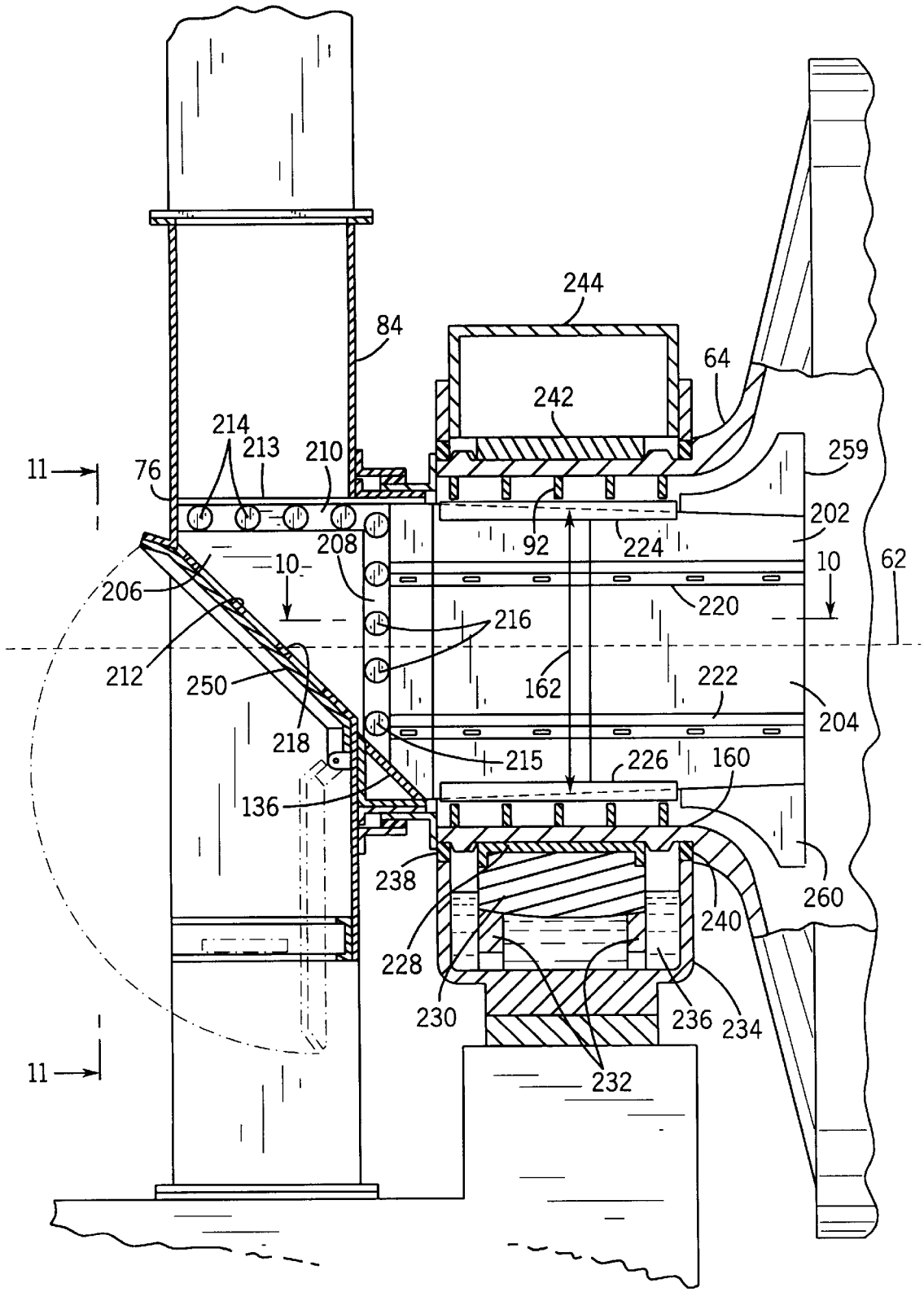
FIG. 9 is a side sectional view of the mill head modified design in accordance with the present invention.
Figure 10:
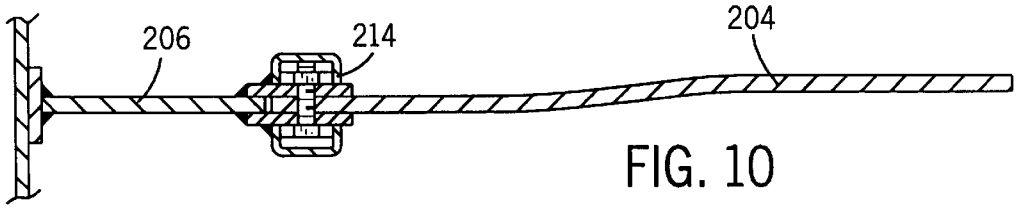
FIG. 10 is a sectional view taken along line 10—10 of FIG. 9.

FIGS. 9–14 show a mill modified in accordance with the invention, and use like reference numerals from above where appropriate to facilitate understanding. Divider plate 72 of FIGS. 1–8 is replaced with a divider plate 202, FIG. 9, having a first portion 204 within inner perimeter 160 at rifling 92, and an axial end portion 206 which is triangular, including a substantially vertical leg 208 extending along inner diameter 162, a substantially horizontal leg 210 extending axially outwardly from vertical leg 208, and a diagonal leg 212 joining the vertical and horizontal legs. Axial end triangular portion 206 is bolted to the stationary framework 76. An upper horizontal support rail 213 is welded to stationary framework 76, and end portion 206 is bolted to rail 213 at a plurality of bolts 214. The lower end of portion 206 is bolted to end wall 136 at bolt 215. Inner divider plate 204 is bolted to portion 206 by a plurality of bolts 216. Diagonal leg 212 of end portion 206 is bolted to door 250 by a plurality of bolts 218. Divider plate portion 204 further preferably has one or more angle iron guides 220,222 welded thereto and providing additional support against bending. Also added to the plate are upper and lower dimensional tolerance strips 224,226 which are welded or otherwise attached to the upper and lower edges of the divider plate to provide a very small tolerance gap, preferably about ¼ inch, to the rifling at 92, to prevent bypass of larger chunks of coal from entrance 80 to exit 86. FIG. 9 also shows further details of the trunnion bearing supporting rotation of the drum at mill head 64, including a semicircular half moon bearing 228 on backing 230 on support blocks 232 in oil reservoir 234 filled with oil 236 and having annular cross-sectionally-square packing seals 238,240, an upper race 242, and an upper cap 244.

Figure 11:
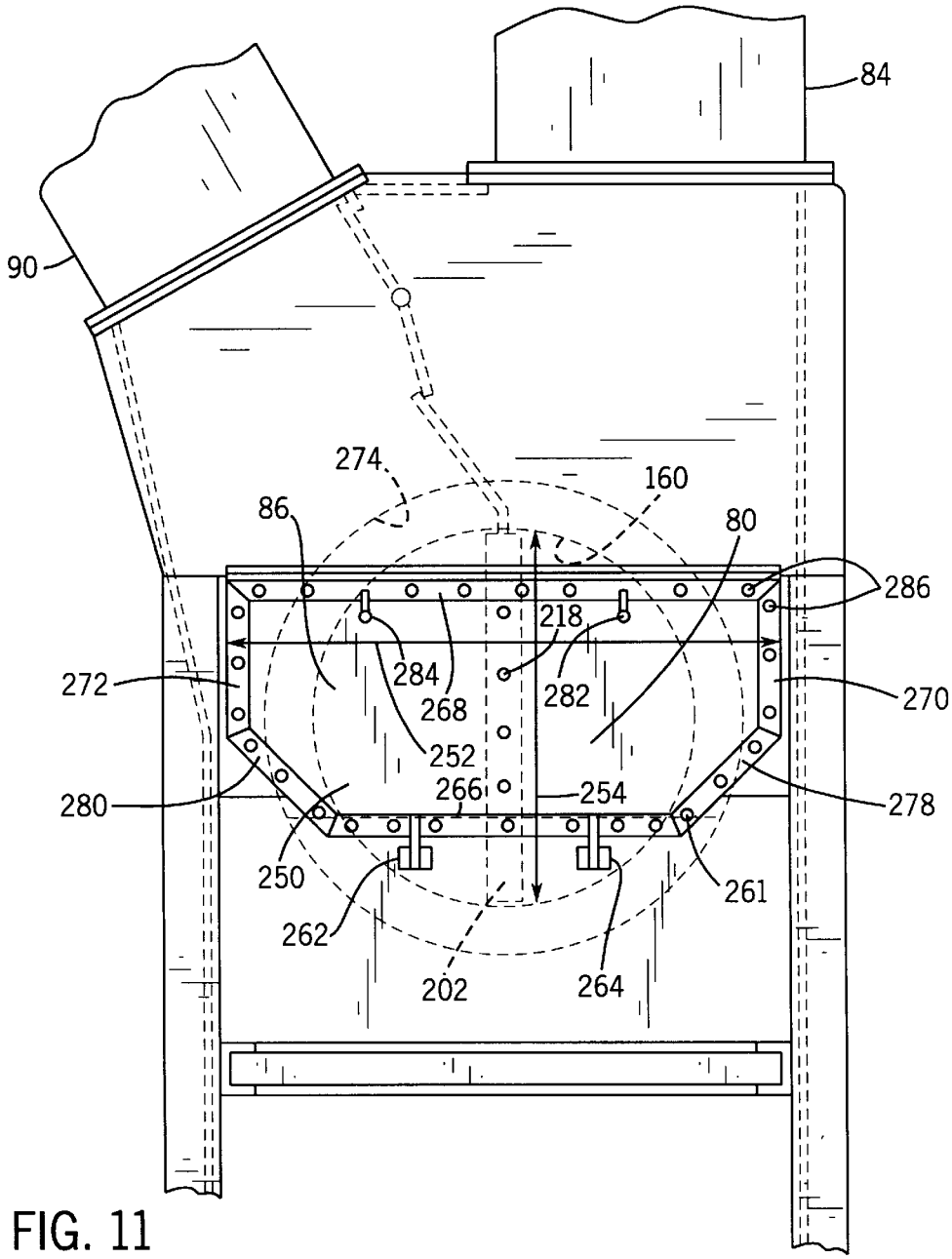
FIG. 11 is an end view taken along line 11—11 of FIG. 9.
Figure 12:
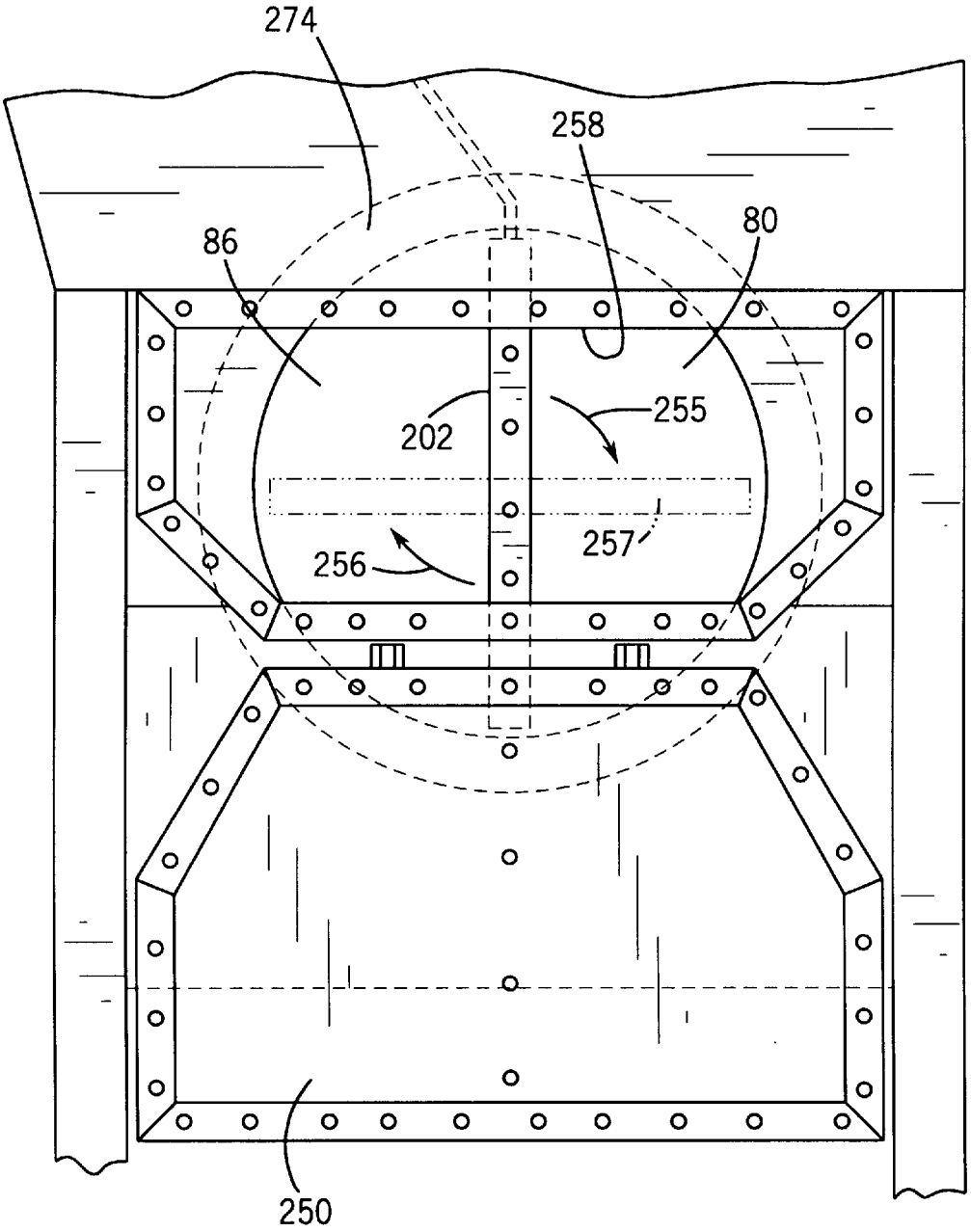
FIG. 12 is like FIG. 11 and shows the door in an open position.
Figure 13:
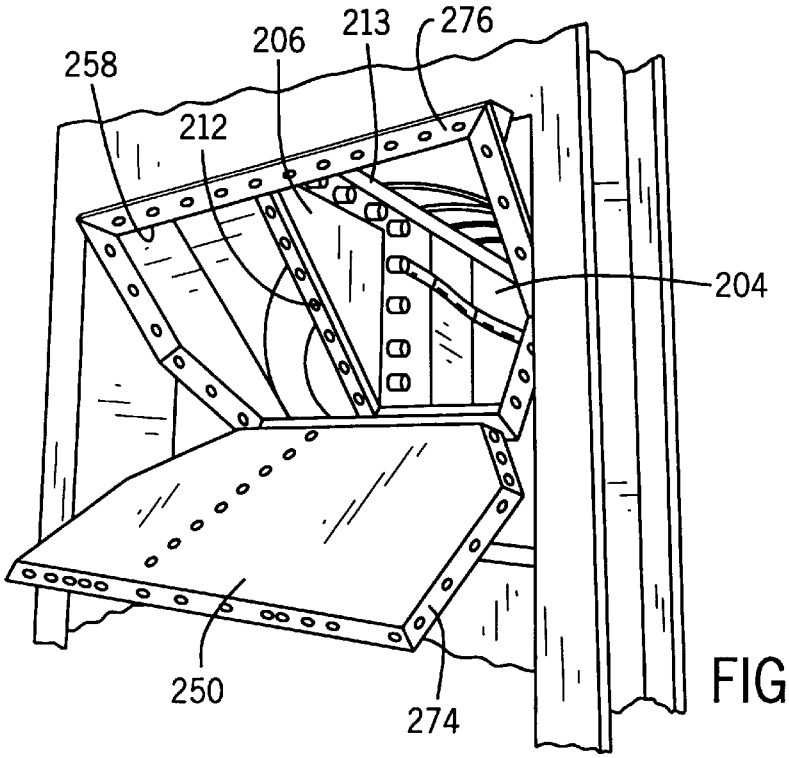
FIG. 13 is a perspective view of the mill head with the door in the open position.
Figure 14:
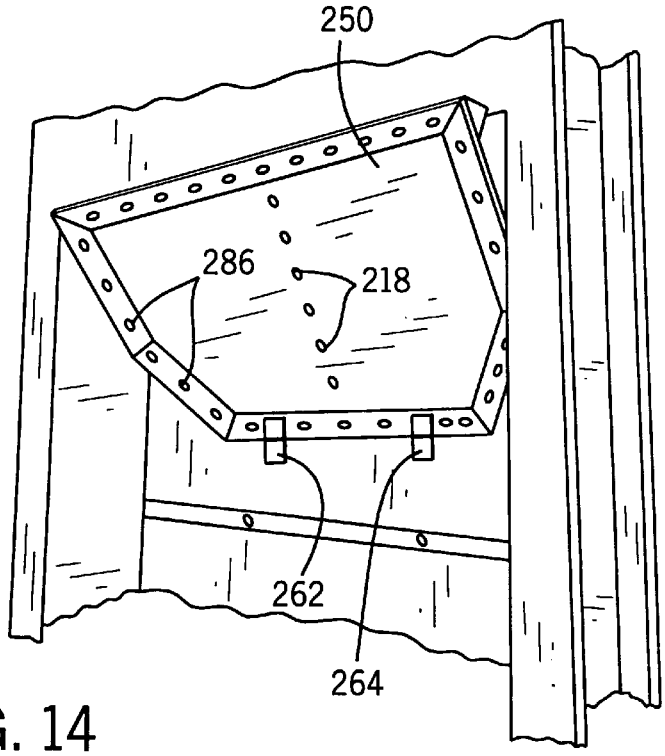
FIG. 14 is a perspective view of the mill head with the door in the closed position.

Openable door 250 on the mill head is moveable between a closed position, FIGS. 9,11 and 14, and an open position, FIGS. 12 and 13. In the closed position, door 250 is intersected by axis 62, which is the rotational axis of drum 30. Mill head inner diameter 162 is bisected by axis 62. Door 250 has a lateral dimension 252, FIG. 11, transverse to axis 62 and greater than inner diameter 162. Divider plate 202 extends along a lateral dimension 254, FIG. 11, transverse to axis 62 and also transverse to lateral dimension 252 of door 250. Lateral dimension 252 of door 250 extends horizontally, and lateral dimension 254 of divider plate 202 extends vertically. Divider plate 202 extends generally vertically in the mill head and has a height in the mill head substantially equal to inner diameter 162. Removal of divider plate 202 is accomplished by removing bolts 214–216, and then rotating divider plate 202 by 90° about axis 62, as shown at arrows 255, 256 in FIG. 12, to a horizontal position as shown in dashed line at 257. The now horizontal divider plate 202 at position 257 is then withdrawn axially through door opening 258 in the mill head axial end, with door 250 is in its open position, FIGS. 12 and 13. In applications where the divider plate has inner end flanges 259 and 260 extending radially beyond the noted inner perimeter, then such flanges are removed prior to withdrawal of the divider plate.

Door 250 is pivoted about a horizontal hinge line 261 spaced below axis 62 at hinges 262 and 264. The horizontal length of the bottom 266 of the door along hinge line 260 is less than inner diameter 162. The top 268 of the door is spaced above axis 62 and extends horizontally and has a horizontal length greater than inner diameter 162. Top 268 lies in a horizontal plane vertically spaced above bottom 266 by a distance less than inner diameter 162. The door has distally opposite right and left sides 270 and 272. The mill head defines a cylinder whose axial projection as shown at 274 in FIG. 11 through the axial end of the mill head intersects distally opposite top and bottom sides 268 and 266 but not the pair of distally opposite right and left sides 270 and 272. Sides 270 and 272 are spaced laterally outwardly of axial projection 274 of the cylinder. Sides 270 and 272 are spaced apart by a distance greater than inner diameter 162.

Door 250 in its closed position spans divider wall 202 at leading axial diagonal end 212 of triangular portion 206 and closes both entrance 80 and exit 86 of the mill head. Door 250 in its open position, FIG. 12, exposes both entrance 80 and exit 86. Axial end 212 of the divider plate is engaged by door 250 in its closed position and is bolted thereto by bolts 218. As above noted, divider plate 202 at its outward axial end includes triangular portion 206 having a substantially vertical leg 208 extending along inner diameter 162, a substantially horizontal leg 210 extending axially outwardly from vertical leg 208, and a diagonal leg 212 joining the vertical and horizontal legs. Door 250 engages the axially outwardly facing end of diagonal leg 212. Horizontal leg 210 extends axially from the top of vertical leg 208, and diagonal leg 212 extends from the bottom of vertical leg 208 axially outwardly and upwardly.

Door 250 has a polygonal perimeter engaging the axial end of the mill head along a beveled interface 274, 276, FIG. 13, to guide a nested and sealed engagement of the door therewith. The lower beveled edge of the door has the noted hinges 262,264 mounted thereto. In the preferred embodiment, the polygonal perimeter of the door has six sides, all beveled, including the noted top and bottom parallel sides 268 and 266 spaced by a distance less than inner perimeter 162, the noted right and left parallel sides 270 and 272 spaced by a distance greater than inner diameter 162, and fifth and sixth non-parallel sides 278 and 280, FIG. 11. Side 278 extends between sides 266 and 270. Side 280 extends between sides 266 and 272. Door 250 and door opening 258 preferably have strips bolted or tack welded thereto to provide good sealing engagement. The door is held in its closed position by bolts 218, 282, 284 and a plurality of perimeter bolts 286.

In an alternative embodiment, a small opening may be provided through door 250, and a small sub-door is added thereto, similarly to door 32, to provide limited access even with door 250 in its closed position. Door 250 would still have to be opened to enable removal of divider plate 202, at least without cutting the latter into smaller sub-pieces as noted above.

It is recognized that various equivalents, alternatives and modifications are possible within the scope of the appended claims.

What is claimed is:

1. In a mill in a coal-burning utility electrical power generation plant, said mill comprising a rotary drum for pulverizing coal, said drum being rotational about an axis and having a mill head at an axial end thereof, said mill head having an inner diameter bisected by said axis, a stationary divider plate dividing said mill head into an entrance receiving coal, and an exit discharging pulverized coal dust, an openable door on said mill head and moveable between a closed position and an open position, said door in said closed position being intersected by said axis and having a lateral dimension transverse to said axis and greater than said inner diameter.

2. The invention according to claim 1 wherein said divider plate extends along a lateral dimension transverse to said axis and transverse to said lateral dimension of said door.

3. The invention according to claim 2 wherein said lateral dimension of said door extends horizontally, and said lateral dimension of said divider plate extends vertically.

4. The invention according to claim 1 wherein said divider plate extends generally vertically in said mill head and has a height in said mill head substantially equal to said inner diameter, and wherein said lateral dimension of said door extends generally horizontally, such that removal of said divider plate requires 90 degree rotation thereof about said axis followed by withdrawal of said divider plate axially through said mill head at said axial end when said door is in said open position.

5. The invention according to claim 4 wherein said door is pivoted about a horizontal hinge line spaced below said axis, and wherein said door has a horizontal length along said hinge line less than said inner diameter.

6. The invention according to claim 5 wherein said door has a bottom extending horizontally along said hinge line, and a top spaced above said axis and extending horizontally, wherein the horizontal length of said bottom is less than said inner diameter, the horizontal length of said top is greater than said inner diameter, and wherein said top lies in a horizontal plane vertically spaced above said bottom by a distance less than said inner diameter.

7. The invention according to claim 1 wherein said door has a top side, a bottom side, a right side, and a left side, two of said sides being distally opposite to each other and forming a first pair of sides, the other two of said sides forming a second pair of sides, and wherein said mill head defines a cylinder whose axial projection through said axial end intersects said first pair of sides but not said second pair of sides.

8. The invention according to claim 7 wherein said second pair of sides are spaced laterally outwardly of said axial projection of said cylinder.

9. The invention according to claim 8 wherein said second pair of sides are spaced from each other by a distance greater than said inner diameter.

10. The invention according to claim 9 wherein said first pair of sides are spaced from each other by a distance less than said inner diameter.

11. The invention according to claim 1 wherein said door has a top, a bottom, and right and left sides, and wherein said mill head defines a cylinder whose axial projection through said axial end intersects said top and said bottom but not said right and left sides.

12. The invention according to claim 11 wherein said right and a left sides are spaced laterally outwardly of and horizontally from said axial projection of said cylinder.

13. The invention according to claim 12 wherein said right and left sides are horizontally spaced from each other by a distance greater than said inner diameter.

14. The invention according to claim 13 wherein said top and said bottom are spaced from each other by a distance less than said inner diameter.

15. The invention according to claim 1 wherein said door in said closed position spans said divider plate and closes both said entrance and said exit of said mill head.

16. The invention according to claim 15 wherein said door in said open position exposes both said entrance and said exit.

17. The invention according to claim 16 wherein said divider plate has an axial end engaged by said door in said closed position.

18. The invention according to claim 17 wherein said divider plate at said axial end includes a triangular shaped portion including a substantially vertical leg extending along said inner diameter, a substantially horizontal leg extending axially outwardly from said vertical leg, and a diagonal leg joining said vertical and horizontal legs, and wherein said door engages the axially outwardly facing end of said diagonal leg.

19. The invention according to claim 18 wherein said horizontal leg extends axially from the top of said vertical leg, and wherein said diagonal leg extends from the bottom of said vertical leg axially outwardly and upwardly.

20. The invention according to claim 1 wherein said door has a polygonal perimeter engaging said axial end along a beveled interface to guide a nested and sealed engagement of said door therewith.

21. The invention according to claim 20 wherein said polygonal perimeter comprises six sides, all beveled.

22. The invention according to claim 20 wherein said polygonal perimeter comprises first and second parallel sides spaced by a distance less than said inner diameter, third and fourth parallel sides spaced by a distance greater than said inner diameter, and fifth and sixth non-parallel sides, said fifth side extending between said second and third sides, said sixth side extending between said second and fourth sides.

23. The invention according to claim 20 wherein said door has a beveled edge with a pair of hinges mounted thereto.

24. The invention according to claim 23 where said door pivots about a horizontal pivot axis along said hinges.

25. The invention according to claim 1 wherein said door has a polygonal perimeter comprising first and second distally opposite sides, and third and fourth distally opposite sides, said third and fourth sides being spaced by a distance greater than said inner diameter.

26. The invention according to claim 25 wherein said first and second sides are spaced by a distance less than said inner diameter.

27. The invention according to claim 25 wherein said first and second sides are parallel to each other, and said third and fourth sides are parallel to each other.

28. A mill for a coal-burning utility electrical power generation plant comprising a rotary drum for pulverizing coal, said drum being rotational about an axis and having a mill head at an axial end thereof, said mill head having an inner diameter bisected by axis, a stationary divider plate dividing said mill head into an entrance receiving coal, and an exit discharging pulverizing coal dust, an openable door on said mill head and moveable between a closed position and an open position, said door in said closed position being intersected by said axis and having a lateral dimension transverse to said axis and greater than said inner diameter, said divider plate extending along a lateral dimension transverse to said axis and also transverse to said lateral dimension of said door.

29. The invention according to claim 28 wherein said door has a top side, a bottom side, a right side, and a left side, two of said sides being distally opposite to each other and forming a first pair of sides, the other two of said sides forming a second pair of sides, and wherein said mill head defines a cylinder whose axial projection through said axial end intersects at least one of said sides of said first pair of sides but not said second pair of sides.

* * * * *